US007878210B2

(12) United States Patent
Lipowicz et al.

(10) Patent No.: US 7,878,210 B2
(45) Date of Patent: Feb. 1, 2011

(54) CELLULOSE ACETATE FIBER MODIFICATION

(75) Inventors: Peter Lipowicz, Midlothian, VA (US); Shalva Gedevanishvili, Richmond, VA (US); Lixin L. Xue, Midlothian, VA (US); Milton E. Parrish, Midlothian, VA (US); Vicki L. Baliga, Chesterfield, VA (US)

(73) Assignee: Philip Morris USA Inc., Richmond, VA (US)

( * ) Notice: Subject to any disclaimer, the term of this patent is extended or adjusted under 35 U.S.C. 154(b) by 427 days.

(21) Appl. No.: 12/155,223

(22) Filed: May 30, 2008

(65) Prior Publication Data

US 2009/0000633 A1 Jan. 1, 2009

Related U.S. Application Data

(60) Provisional application No. 60/924,864, filed on Jun. 4, 2007.

(51) Int. Cl.
*A24D 3/06* (2006.01)

(52) U.S. Cl. ..... 131/345; 131/331; 131/332

(58) Field of Classification Search ..... None
See application file for complete search history.

(56) References Cited

U.S. PATENT DOCUMENTS

| | | | | |
|---|---|---|---|---|
| 4,285,892 | A | 8/1981 | Betsuda et al. | |
| 4,411,280 | A * | 10/1983 | Floyd et al. | 131/332 |
| 4,469,554 | A | 9/1984 | Turner | |
| 4,744,932 | A | 5/1988 | Browne | |
| 4,821,750 | A | 4/1989 | Browne | |
| 5,290,398 | A | 3/1994 | Feldman et al. | |
| 5,453,144 | A | 9/1995 | Kauffman et al. | |
| 5,462,801 | A * | 10/1995 | Willmund | 428/372 |
| 5,478,386 | A | 12/1995 | Itoh et al. | |
| 5,491,024 | A | 2/1996 | Brodof et al. | |
| 5,495,860 | A | 3/1996 | Teufel et al. | |
| 5,509,430 | A | 4/1996 | Berger | |
| 5,664,586 | A | 9/1997 | Sinclair et al. | |
| 5,678,577 | A | 10/1997 | Matsumura et al. | |

(Continued)

FOREIGN PATENT DOCUMENTS

BE 1007973 A7 11/1995

(Continued)

OTHER PUBLICATIONS

International Preliminary Report on Patentability issued Dec. 7, 2009 for PCT/IB2008/002530.

(Continued)

*Primary Examiner*—Philip C Tucker
*Assistant Examiner*—Michael J Felton
(74) *Attorney, Agent, or Firm*—Buchanan Ingersoll & Rooney PC

(57) ABSTRACT

Cellulose acetate fibers can be modified to have physical imperfections and then incorporated into cigarette filter plugs as filtering materials. Cellulose acetate fiber modification can be achieved by etching with a gas phase etchant or a liquid phase etchant comprising hydrogen peroxide. Modification of cellulose acetate fibers may be performed at various stages during the manufacture of cigarette filter plugs. Furthermore, cigarette filter plugs containing modified cellulose acetate fibers can also have spaced apart slits along the length of the cigarette filter plugs.

12 Claims, 3 Drawing Sheets

U.S. PATENT DOCUMENTS

| | | | |
|---|---|---|---|
| 5,709,227 | A | 1/1998 | Arzonico et al. |
| 5,738,119 | A | 4/1998 | Edwards, III et al. |
| 5,779,736 | A | 7/1998 | Frederick et al. |
| 5,817,159 | A | 10/1998 | Cahill et al. |
| 5,839,448 | A | 11/1998 | Woodings |
| 5,856,006 | A | 1/1999 | Asai et al. |
| 5,911,224 | A | 6/1999 | Berger |
| 5,913,311 | A | 6/1999 | Ito et al. |
| 5,947,126 | A | 9/1999 | Wilson et al. |
| 5,970,988 | A | 10/1999 | Buchanan et al. |
| 5,998,500 | A | 12/1999 | Cahill et al. |
| 6,062,228 | A | 5/2000 | Loercks et al. |
| 6,133,439 | A | 10/2000 | Buchanan et al. |
| 6,203,660 | B1 | 3/2001 | Unger et al. |
| 6,571,802 | B1 | 6/2003 | Yamashita |
| 6,908,421 | B2 | 6/2005 | Koborinai et al. |
| 7,071,249 | B2 | 7/2006 | Ho et al. |
| 2004/0177855 | A1 | 9/2004 | Garthaffner |
| 2005/0123681 | A1 | 6/2005 | Lee |
| 2006/0093290 | A1 | 5/2006 | Fishteyn |

FOREIGN PATENT DOCUMENTS

| | | | |
|---|---|---|---|
| DE | 19753193 | A1 | 5/1999 |
| GB | 564883 | A | 10/1944 |
| JP | 9195161 | A | 7/1997 |

OTHER PUBLICATIONS

Ishigaki, Tomonori et al., *Effect of UV Irradiation on Enzymatic Degradation of Cellulose Acetate*, Polymer Degradation and Stability 78 (2002) 505-510, Received Feb. 19, 2002; received in revised from Jun. 4, 2002; accepted Jun. 17, 2002; 2002 Elsevier Science Ltd., PII: S0141-3910(02)00197-0.

International Search Report and Written Opinion mailed Mar. 9, 2009 for PCT/IB2008/002530.

* cited by examiner

CELLULOSE ACETATE FIBER MODIFICATION

CROSS-REFERENCE TO RELATED APPLICATION

This application claims priority under 35 U.S.C. §19 to U.S. Provisional Application No. 60/924,864 entitled CELLULOSE ACETATE FIBER MODIFICATION, filed Jun. 4, 2007, the entire content of which is hereby incorporated by reference.

BACKGROUND

Cellulose acetate (CA) fibers are often used in producing tobacco smoking filter plugs for smoking articles such as cigarettes. In a conventional process of manufacturing a cigarette filter plug, cellulose acetate fibers are crimped, entangled and bonded to each other by binders such as triacetin (i.e., glycerin triacetate).

After a smoking article is consumed, it is discarded. Typically, cellulose acetate fibers contained in the smoking article degrade slower than tobacco and/or the paper parts of the cigarette article, thereby contributing litter to the environment. To reduce the environmental burden of discarded filtered smoking articles, there is interest in improved techniques for developing cigarette filter plugs containing cellulose acetate fibers having an improved degradation rate.

SUMMARY

According to one embodiment, a process for making a cigarette filter plug containing a plurality of cellulose acetate fibers having physical imperfections comprises: (a) forming a cigarette filter rod with cellulose acetate fibers; and (b) cutting the cigarette filter rod into a plug of predetermined length, wherein the process further comprises a step of etching the cellulose acetate fibers by a gas phase etchant or a liquid phase etchant comprising hydrogen peroxide. The etching step may be carried out prior to, during or subsequent to the formation of the cigarette filter rod.

BRIEF DESCRIPTION OF THE DRAWING FIGURES

DETAILED DESCRIPTION

Figure 1:
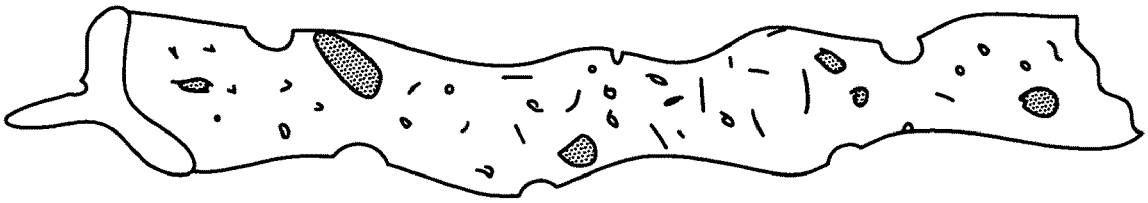
FIG. 1 is a schematic of an exemplary modified cellulose acetate fiber having a non-uniform cross-section of a Y shape.

The present application discloses processes for making a cigarette filter plug containing a plurality of cellulose acetate fibers having physical imperfections, which comprise forming a cigarette filter rod with cellulose acetate fibers, and then cutting the cigarette filter rod into a plug of predetermined length, in which the cellulose acetate fibers are subjected to an etching process.

In one embodiment, the etching step can be carried out by exposing cellulose acetate fibers to a gas phase etchant. The gas phase etchant can be ozone, chlorine oxides or nitrogen oxides. In a preferred embodiment, the gas phase etchant can be ozone.

In another embodiment, the etching step can be carried out by exposing cellulose acetate fibers to a liquid phase etchant comprising hydrogen peroxide.

In a further embodiment, the gas phase etching step can be carried out prior to, during or subsequent to the formation of the cigarette filter rod. In a preferred embodiment, the etching step can be carried out subsequent to the formation of the cigarette filter rod.

In another embodiment, the cigarette filter plugs containing modified cellulose acetate fibers may also include spaced apart slits along the length of the cigarette filter rod.

In a further embodiment, the spaced apart slits can be substantially parallel to each other and can be located in a direction substantially perpendicular to the length of the cigarette filter rod.

A filter comprising a segment of the filter plug containing modified cellulose acetate fibers can be attached to a tobacco rod by tipping paper.

Cellulose esters may be formed by reacting cellulose and an acid anhydride. Cellulose is a polysaccharide of glucose unit and contains anhydroglucose units as its fundamental repeating structure. Each anhydroglucose unit in a cellulose chain has three hydroxyl groups where ester substitution may occur. The degree of substitution (DS) of a cellulose ester refers to the number of substituents per anhydroglucose unit, and can have a non-integral value up to three. For example, cellulose triacetate has a DS of 3 and cellulose diacetate has a DS of 2.

The cellulose acetate fibers described herein can be prepared using any suitable technique. For instance, cellulose acetate can be spun into a fiber either by melt-spinning or by spinning from an appropriate solvent (e.g., acetone, acetone/water, tetrahydrofuran, methylene chloride/methanol, chloroform, dioxane, N,N-dimethylformamide, dimethylsulfoxide, methyl acetate, ethyl acetate or pyridine). Preferably, the solvent contains acetone. Generally, when spinning from a solvent, the choice of solvent depends on the DS number of cellulose acetate. Commercially available cellulose acetate fibers for use as filtering materials in smoking articles typically have a DS of about 2.5.

As described herein, the cellulose acetate fibers having an increased surface area (also referred to as "modified cellulose acetate fibers"). The average DS value of the modified cellulose acetate fibers can be in the range of about 1.0 to about 3.0 and preferably, about 1.5 to about 2.5, and more preferably, about 2.0 to 2.5.

The modified cellulose acetate fibers have physical imperfections. As used herein, the term "physical imperfections" refers to any physical damage including, but is not limited to, uneven or rough surfaces, voids, craters, holes, and/or fiber breakage, which may not be visible to human eyes.

Cellulose acetate fiber modification can be achieved by various methods including an etching process. As used herein, the term "etching" refers to a process which introduces physical imperfections (or damages) to portion(s) of a solid material. As a result, the etched cellulose acetate fibers may have rough or uneven surfaces, voids, craters, holes, either on the surface or within the body of the fibers, and/or fiber breakage. The extent and/or dimensions of the physical imperfections may vary depending on the extent of the etching treatment.

The dimensions of cellulose acetate fibers suitable for use as filtering materials in smoking articles are not particularly limited. Typically, the cellulose acetate fibers have a mean diameter of from about 20 microns to about 100 microns, and preferably, from about 30 microns to about 50 microns. Preferably, the cellulose acetate fibers have a non-uniform cross section such as a Y shape (see FIG. 1) and a H shape.

The etching process can be carried out by exposing cellulose acetate fibers to a gas phase etchant. The cellulose acetate fibers may be CA fibers in any form during the production of filter plugs, such as CA tow band, a filter rod and a filter plug containing the same. Any appropriate gas phase etching method may be used. For instance, cellulose acetate fibers may be placed in a chamber, the air in which is then at least partially drawn under a reduced pressure and subsequently replaced with a gas phase etchant. Alternatively, a gas phase etchant may be continuously or periodically passed through a chamber having an inlet and an outlet and containing cellulose acetate fibers. Preferably, cellulose acetate fibers are placed in a tube, wherein drawing air at one end and supplying a gas phase etchant at the other end are performed simultaneously.

Examples of suitable gas phase etchants include, but are not limited to, ozone, chlorine oxides and nitrogen oxides. Chlorine oxides include the compounds represented by the formula $Cl_xO_y$ wherein x is 1 or 2, and y is an integer of from 1 to 7, such as ClO, $ClO_2$, $ClO_3$, $Cl_2O$, $Cl_2O_2$, $Cl_2O_3$, $Cl_2O_4$, $Cl_2O_6$ and $Cl_2O_7$, and is preferably $ClO_2$. Nitrogen oxides include the compounds represented by the formula $N_{x'}O_{y'}$ wherein x' is 1 or 2, and y' is an integer of from 2 to 5, such as $NO_2$, $N_2O_3$, $N_2O_4$ and $N_2O_5$, and is preferably, $NO_2$. In a preferred embodiment, the gas phase etchant is ozone.

In an alternative, the etching process can be carried out by exposing cellulose acetate fibers to a liquid phase etchant such as an aqueous hydrogen peroxide solution. Preferably, the aqueous hydrogen peroxide solution has a concentration ranging from 1 wt % to 30 wt %. Any appropriate liquid phase etching method may be used. For instance, cellulose acetate fibers or shaped body of such fibers may be suspended in a hydrogen peroxide solution and then dried.

Figure 2A:
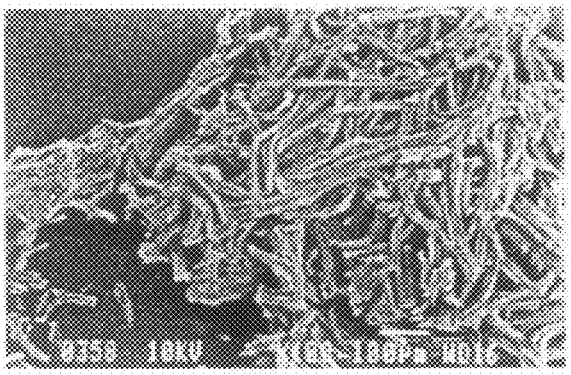
FIG. 2 are pictures of cellulose acetate cigarette filter plugs containing 8 wt % triacetin after treatment with various concentrations of hydrogen peroxide solutions and water, and non-treated control: (a) 10 wt % hydrogen peroxide; (b) 20 wt % hydrogen peroxide; (c) 30 wt % hydrogen peroxide; (d) water; and (e) non-treated control.
Figure 2B:
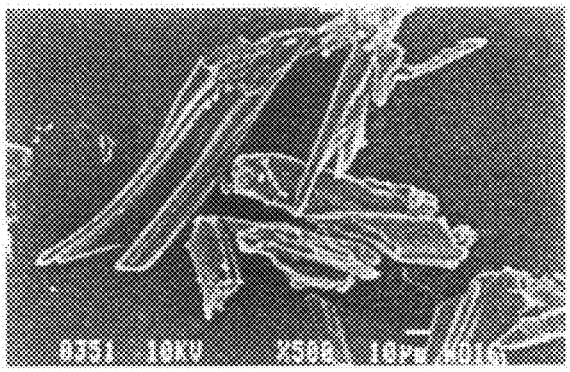
Figure 2C:
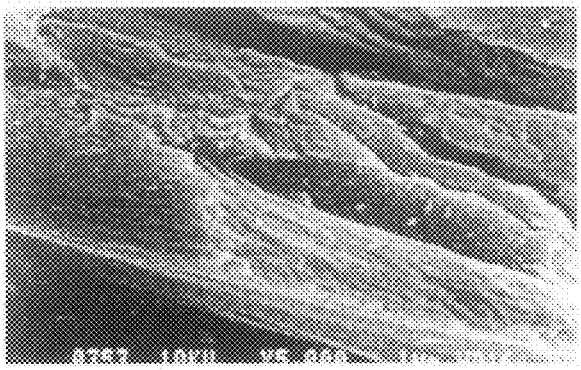

FIG. 2 shows cellulose acetate cigarette filter plugs containing 8 wt % triacetin after treatment with various concentrations of hydrogen peroxide solutions and water at ambient temperature for seven days, as well as non-treated control. These pictures were taken using Zeiss Stemi SV11 stereo light microscope. Specifically, FIG. 2(*a*) shows a cellulose acetate filter plug treated with a 10 wt % hydrogen peroxide solution, which showed partial breakage with some resemblance of cigarette filter plug shape. FIG. 2(*b*) shows a cellulose acetate filter plug treated with a 20 wt % hydrogen peroxide solution, which lost much of the original filter plug shape. FIG. 2(*c*) shows a cellulose acetate filter plug treated with a 30 wt % hydrogen peroxide solution, which showed breakage into multiple pieces of shortened fiber length with no indication of the filter plug shape. FIG. 2(*d*) shows a cellulose acetate filter plug treated with water, which showed minimal loss of fiber length or shape of the cigarette filter plug. FIG. 2(*e*) shows a non-treated cellulose acetate filter plug (control). It is evident that the higher concentrations of hydrogen peroxide lead to increased fiber degradation and disintegration of CA fibers.

Figures 3A, 3B, 3C, 3D, 3E:
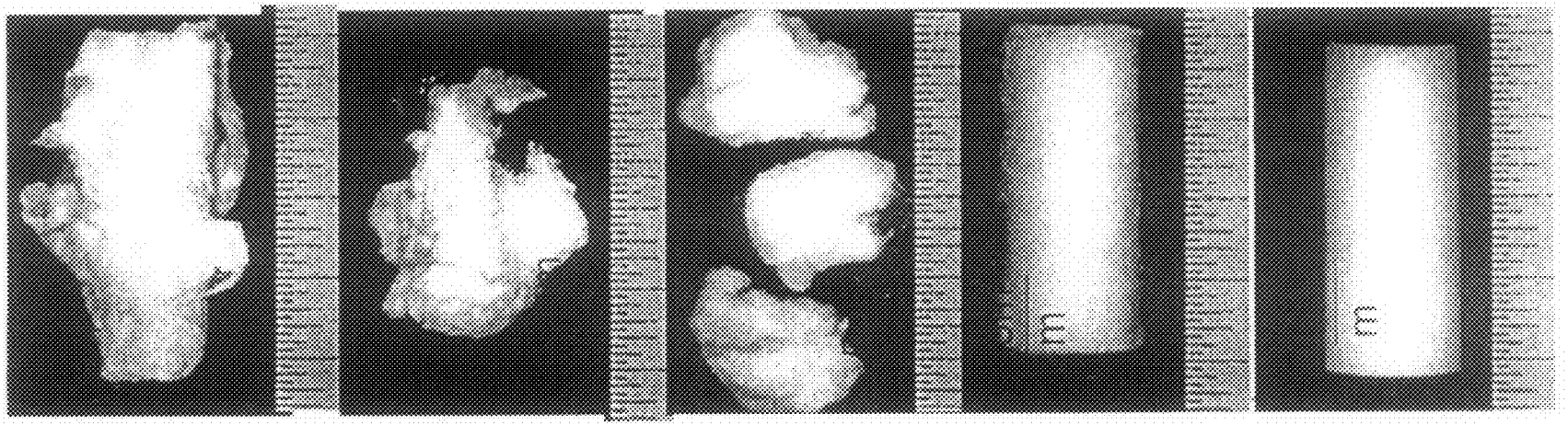
FIG. 3 are pictures of cellulose acetate fibers treated with a 30 wt % hydrogen peroxide solution.

FIG. 3 shows cellulose acetate fibers after suspension in a 30 wt % hydrogen peroxide solution at about 34° C. for 14 days. These pictures were taken using the JEOL 840 Scanning Electron Microscope (SEM). FIG. 3(*a*) shows that monofilaments of Y-shaped fibers broke into short filaments between 1 mm to 0.01 mm in length. FIG. 3(*b*) shows that the fractured filament broke along surface cracks diagonally, perpendicularly and longitudinally along the fibers. FIG. 3(*c*) shows the typical fracture patterns. Increased texture and surface areas are associated with rough exterior surfaces and fracture surfaces.

Compared to the unmodified cellulose acetate fibers, the modified cellulose acetate fibers have an increased surface area, thereby resulting in accelerated biodegradation rates of the spent filters. In addition, increasing the surface area of the filtering material may lead to an increase in filtration efficiency.

The steps involved in the manufacture of cigarette filter plugs are well known to those skilled in the art. Typically, a cigarette filter rod is formed from a commercially available tow band of cellulose acetate fibers and then cut into a predetermined length to form cigarette filter plugs.

Modification of cellulose acetate fibers may be carried out at various stages during the manufacture of cigarette filter plugs. For instance, cellulose acetate fibers may be modified prior to, during or subsequent to the formation of the cigarette filter rod. Preferably, modification is carried out subsequent to the formation of cigarette filter rod.

Generally, during the manufacture of cigarette filter rods, it is necessary that cellulose acetate fibers have certain mechanical properties, e.g., mechanical strength, to minimize loss thereof. Modification to cellulose acetate fibers causes physical imperfections to the cellulose acetate fibers. As a result, the modified cellulose acetate fibers may have diminished mechanical strength. Therefore, when the cellulose acetate fibers are modified prior to the formation of filter rods, the extent of modification may be limited in order to preserve sufficient mechanical strength of the cellulose acetate fibers.

When unmodified cellulose acetate fibers are used to form filter rods and subsequently modified, it is not necessary to preserve the mechanical strength of the fibers. Therefore, the degree of modification is not particularly limited.

As described herein, the cigarette filter plugs containing modified cellulose acetate fibers may further include spaced apart slits along the longitudinal axis (or length) of the filter plugs. These slits can be formed substantially parallel to each other and substantially perpendicular to the length of the filter plugs. Each slit can extend partially into the filter plug preferably midway therethough. The presence of the spaced apart slits may further accelerate the degradation rate of cigarette filter plugs after being used and discarded.

The partially cut slits can include first and second groups of equally spaced apart slits substantially parallel to one another, and the first and second groups may be approximately 180° apart from each other on opposite sides of the filter plug. In particular, the first group may be staggered with respect to the slits of the second group so that each slit of the first group is located between two slits of the second group and vice versa.

While various embodiments have been described with reference to specific embodiments, variations and modifications may be made without departing from the spirit and the scope of the invention. Such variations and modifications are to be considered within the purview and scope of the invention as defined by the appended claims.

All of the above-mentioned references are herein incorporated by reference in their entirety to the same extent as if each individual reference was specifically and individually indicated to be incorporated herein by reference in its entirety.

What is claimed is:

1. A process for making a cigarette filter plug comprising:

(a) forming a cigarette filter rod with cellulose acetate fibers; and (b) cutting the cigarette filter rod into a plug of predetermined length, wherein the process further comprises a step of etching the cellulose acetate fibers to provide physical imperfections therein, which is carried out by exposing the cellulose acetate fibers to a gas phase etchant or a liquid phase etchant comprising hydrogen peroxide, wherein the gas phase etchant comprises at least one selected from the group consisting of ozone, chlorine oxides and nitrogen oxides.

2. The process of claim 1, wherein the gas phase etchant comprises ozone.

3. The process of claim 1, wherein the liquid phase etchant comprises an aqueous solution comprising 1 wt % to 30 wt % hydrogen peroxide.

4. The process of claim 1, wherein the etching step is carried out prior to, during or subsequent to the formation of the cigarette filter rod.

5. The process of claim 1, wherein the etching step is carried out subsequent to the formation of the cigarette filter rod.

6. The process of claim 1, further comprising cutting spaced apart slits into the cigarette filter rod.

7. The process of claim 6, wherein the spaced apart slits are substantially parallel to each other and are located in a direction substantially perpendicular to the length of the cigarette filter rod.

8. A process for producing cellulose acetate fibers for smoking articles having physical imperfections comprising etching cellulose acetate fibers, wherein the etching step is carried out by exposing the cellulose acetate fibers to a gas phase etchant or a liquid phase etchant comprising hydrogen peroxide, wherein the gas phase etchant comprises at least one selected from the group consisting of ozone, chlorine oxides and nitrogen oxides.

9. The process of claim 8, wherein the gas phase etchant comprises ozone.

10. The process of claim 8, wherein the liquid phase etchant comprises an aqueous solution comprising 1 wt % to 30 wt % hydrogen peroxide.

11. A smoking article comprising a filter comprising the filter plug recited in claim 1.

12. The smoking article of claim 11, wherein the smoking article is a cigarette and the filter is attached to a tobacco rod by tipping paper.

* * * * *